US012790939B2

(12) United States Patent
Fuller et al.

(10) Patent No.: US 12,790,939 B2
(45) Date of Patent: Nov. 10, 2026

(54) METHODS AND MATERIALS FOR MONITORING STIMULATION EFFECTIVENESS USING COATED TRACERS

(71) Applicant: CHEVRON U.S.A. INC., San Ramon, CA (US)

(72) Inventors: Michael James Fuller, San Ramon, CA (US); Lauren Churchwell, San Ramon, CA (US); Harold Gordon Riordan, San Ramon, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 81 days.

(21) Appl. No.: 18/742,867

(22) Filed: Jun. 13, 2024

(65) Prior Publication Data

US 2024/0410274 A1 Dec. 12, 2024

Related U.S. Application Data

(63) Continuation-in-part of application No. PCT/US2022/081627, filed on Dec. 15, 2022.

(60) Provisional application No. 63/539,429, filed on Sep. 20, 2023, provisional application No. 63/290,096, filed on Dec. 16, 2021.

(51) Int. Cl.

| | |
|---|---|
| ***E21B 43/04*** | (2006.01) |
| ***E21B 43/267*** | (2006.01) |
| ***E21B 43/27*** | (2006.01) |
| ***E21B 47/11*** | (2012.01) |

(52) U.S. Cl.

CPC ..... *E21B 47/11* (2020.05); *E21B 43/04* (2013.01); *E21B 43/267* (2013.01); *E21B 43/27* (2020.05)

(58) Field of Classification Search

CPC ..... E21B 47/11; E21B 43/27; E21B 43/04; E21B 43/267

See application file for complete search history.

(56) References Cited

U.S. PATENT DOCUMENTS

| | | | | |
|---|---|---|---|---|
| 6,961,284 | B2 | 11/2005 | Moldoveanu | |
| 9,410,934 | B2 * | 8/2016 | Robinson | G01N 21/65 |
| 10,017,684 | B2 * | 7/2018 | Rule | E21B 43/267 |
| 10,961,444 | B1 * | 3/2021 | Bestaoui-Spurr | C09K 8/528 |
| 2010/0307745 | A1 * | 12/2010 | Lafitte | E21B 47/11 166/250.12 |
| 2015/0377010 | A1 * | 12/2015 | Matherly | C09K 8/86 166/250.12 |
| 2016/0168960 | A1 * | 6/2016 | Wetzel, Jr. | E21B 43/08 166/250.01 |
| 2016/0215207 | A1 * | 7/2016 | Maeda | C08L 67/00 |
| 2016/0333258 | A1 * | 11/2016 | Drake | E21B 43/267 |

FOREIGN PATENT DOCUMENTS

| | | | |
|---|---|---|---|
| GB | 2586695 | A | 3/2021 |

OTHER PUBLICATIONS

Moldoveanu, Nick, "Vertical Source Array in Marine Seismic Exploration", SEG 2000 Expanded Abstracts, 2005, 5 pages.

Moldoveanu, et al., "Over/under towed streamer acquisition: A method to extend seismic bandwidth to both higher and lower frequencies", The Leading Edge, Jan. 2007, 14 pages.

Acid fracturing, Jan. 27, 2025; Society of Petroleum Engineers (SPE) _ OnePetro.

Measuring _ definition in the Cambridge English Dictionary.

Measure verb—Definition, pictures, pronunciation and usage notes _ Oxford.com.

Jew et al., "Chemical and Reactive Transport Processes Associated with Hydraulic Fracturing of Unconventional Oil/Gas Shales", Chem Rev 2022, 122, 9198-9263.

* cited by examiner

*Primary Examiner* — Silvana C Runyan

(74) *Attorney, Agent, or Firm* — HUNTON ANDREWS KURTH LLP

(57) ABSTRACT

The present application pertains to a method of tracing acid stimulation treatment in a hydrocarbon well using one or more coated tracers. The method comprises placing the one or more coated tracers at pre-determined downhole locations in the hydrocarbon well. The well is then acid stimulated and the amount of the tracer in a produced fluid from the hydrocarbon well is measured. The one or more coated tracers each comprise a tracer and a coating which are described herein.

26 Claims, 8 Drawing Sheets

Figure 1 - Solid material (zeolite, polymer, mineral or another solid) with embedded solid tracer particles.

Figure 2 - Depiction of recovered tracer to surface

Figure 4 - Depiction of release mechanism

Figure 5 - Depiction of Prepacked screen (laden with coated tracer)

METHODS AND MATERIALS FOR MONITORING STIMULATION EFFECTIVENESS USING COATED TRACERS

CROSS-REFERENCE TO RELATED APPLICATIONS

This application is a continuation-in-part application of pending International Application No. PCT/US2022/081627 filed on Dec. 15, 2022 and published as WO2023/114893 which application claims priority to U.S. Provisional Application No. 63/290,096 filed on Dec. 16, 2021, both applications of which are incorporated herein by reference. This application also claims priority to U.S. provisional application No. 63/539,429 filed Sep. 20, 2023, which application is incorporated herein by reference.

FIELD OF THE DISCLOSURE

The present disclosure relates to methods and materials for monitoring stimulation effectiveness, e.g., use of coated tracers to monitor acid stimulation.

BACKGROUND AND SUMMARY

Quantifying effectiveness of acid stimulation of producer and injector wells is currently primarily assessed by the incremental change in productivity or injectivity following the treatment. However, the effectiveness of acid diversion, or the zonal distribution of injected acids across an entire interval height, is most-often not known after the treatment. Limited methods are available to evaluate the zonal distribution of acid injection, the most common of which involves using downhole temperature sensing (DTS) to monitor temperature changes along an interval height using fiberoptics installed along the length of coiled tubing (CT) that is used to inject the acid. The changes in temperature at different portions along the pay zone indicates zones of highest injectivity; and with the use of acid diverters, the locations of highest acid injection are seen to change in real-time (suggesting the effectiveness of the diverter). However, the use of CT for acid placement and DTS monitoring (of diversion effectiveness) across the pay zone is often infeasible and therefore infrequently conducted. CT is particularly limited when used in stimulating deepwater assets and horizontal completions.

By comparison, methods exist to assess the zonal contribution to production of different zones (depths) of a reservoir following initial completion using dissolvable chemical tracers. These are deployed as part of the initial completion (specifically in completions using sand control screens), with different identifiable tracers installed across zones of different depths. As production occurs, the different tracers begin to dissolve in the produced fluids and are transported to the surface with acid flowback where they can be measured quantitatively. The relative concentrations of the different tracers specific to different intervals in the produced fluids will indicate the relative contributions of those zones to the overall production rates. However, these methods are only suitable for assessing early-life production (due to both the rapid dissolution of the tracers and the need to install these tracers as part of the initial completion). Further, no such similar technology exists for using soluble tracers to assess the effectiveness of acid stimulation, specifically for assessing remedial stimulation later in the well's productive life. Thus, what is needed are improved systems, methods, and materials for monitoring stimulation effectiveness.

Advantageously, the current inventions solve many of the aforementioned issues. In one embodiment the application pertains to a method of tracing acid stimulation treatment in a hydrocarbon well using one or more coated tracers. The method comprises placing the one or more coated tracers at pre-determined downhole locations in the hydrocarbon well. The coated tracer may be acid-soluble. The well is then acid stimulated and the amount of the tracer in a produced fluid from the hydrocarbon well is measured. The one or more coated tracers each comprise a tracer and a coating which are not particularly limited and described herein.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Various embodiments of the present disclosure, together with further objects and advantages, may best be understood by reference to the following description taken in conjunction with the accompanying drawings.

DETAILED DESCRIPTION

Figure 1:
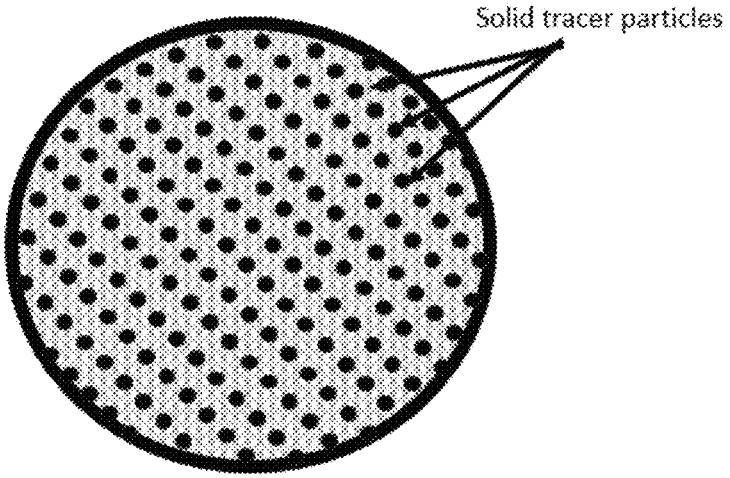
FIG. 1 shows a solid material (zeolite, polymer, mineral or another solid) with embedded solid tracer particles.

This application details suitable materials and properties to enable methods of using coated tracers in stimulation applications. In this application, a series of coated tracers may be deployed at known locations and/or depths in a lower completion that implements, for example, pressure pumping. The target completions may include hydraulic fracturing (single-and multi-stage); cased-hole frac pack (single or multiple stages); open-hole gravel pack; cased-hole gravel pack; and/or high-rate water pack. If desired, the coated tracers may be deployed as part of the original completion along with the proppant. For convenience, as used herein "proppant" is any natural or synthetic material used in fracking and also includes gravel as used in gravel packs. Proppants include, for example, treated or untreated sand, gravel, or ceramics, as well as gravel as employed in gravel packs. In some embodiments, coated tracers may be employed in pre-packed screens with different identifiable tracers installed across zones of different depths.

Typically, the coated tracers will remain downhole during initial shut-in as well as initial production or injection conditions with the tracer substantially to fully protected from premature release. That is, the coating and tracer may be designed to be inert for long periods of time (months or years). The coated tracer is configured to become "activated" upon acid stimulation of the candidate well or zone(s). That is, in some embodiments the coating may be designed to be acid-soluble and release the tracer into the injected or spent-acid only from the zones that received acid. The acid flowback to the surface would then be laden with released tracer from only those zones that received acid, and the detection of the identity and relative concentration of various tracers would indicate which zones were adequately stimulated.

Similarly, the absence of specific tracers would indicate those zones which were originally marked with coated tracers and received inadequate stimulation with acid. The current application details methods of use of a representative series of materials that could be used in the desired coated tracers, including various active tracer core materials, coating materials, and properties of the composite coated tracer material.

Methods of Use in Field-Deployment and Measurement

The current application describes methods whereby coated tracers are deployed downhole in advance of remedial stimulation operations on those wells to stimulate their productivity or injectivity. The term "acid stimulation" or "acid stimulating" includes the use of an acid in any method to enhance production, recovery, and/or injectivity of a subterranean well. Such methods include, for example, methods of enhanced oil recovery (EOR) that use acidic fluids to improve the productivity, recovery, and/or injectivity of a candidate well.

The identity and relative concentration of one or more tracers recovered to the surface will assist in identifying the specific zones that received acid during the stimulation. The specific acid stimulation may employ acid alone or in combination with other substances. In some cases, it may be desired to optionally include chemical diverters and/or perhaps use a mechanical means of acid placement/diversion. This data obtained from the identity and relative concentration of one or more tracers may indicate the specific screen segments, as separated by annular packers. Alternatively or additionally, the data could indicate the specific interval depths that received acid in cases where no annular isolation was installed in the lower completion.

Candidate Wells and Applications

The methods and coated tracers may be used in a wide variety of completion types. That is, the range of wells that could possibly benefit and the specific methods of deploying coated tracers downhole are not particularly limited. Representative completion types that may benefit from the described methods and coated tracers includes any completion that deploys injected solids within the initial completion execution and more particularly those completions that employ pressure pumping of some type. Useful completion types may include a gravel pack operations, e.g., standalone, wherein coated tracers could be co-injected with gravel downhole during the installation of the initial completion. In this manner, a series of individual tracers would be placed at known depths along an annular gravel pack.

The methods and coated tracers may be used in, for example, hydraulic fracturing or frac pack operations. The specific delivery methods may vary depending upon the well, specific fracturing techniques, and desired results.

In some embodiments, one or more coated tracers may be sequentially injected with a suitable proppant such as sand and/or gravel into a single fracture, the screen annulus, or both. In this application, the tracers should be placed in such manner that appropriate data could be obtained later. If, by comparison, co-injecting is employed then the one or more coated tracers could be added into one or more up to all of the various phases of the frac pumping schedule. Such phases may include early phases which are typically low proppant loading, late phases which are typically higher proppant loading, or even in multiple phases of a given frac design. Advantageously, the use of multiple coated tracers placed within a single fracture can provide data through analysis of flowback identity and relative concentrations of each tracer to confirm the depth of penetration of acid into that fracture. In some embodiments, empirical prediction or modelling may be employed to predict an approximate location where each distinct tracer will deposit into the frac half-length.

In some embodiments, the one or more coated tracers may be co-injected with a suitable proppant in a multi-stage hydraulic fracturing or frac pack operation. Such co-injection may be employed during the initial frac operation. As described above, suitable hydrocarbon candidate wells are not particularly limited and in some embodiments they may include a well accessing a conventional formation or an unconventional (shale or tight) formation. Such well may include any mineralogy type. If used in the multi-stage hydraulic fracturing, then it may be useful to employ multiple distinct coated tracers and add them individually into multiple fracs (or frac packs) in the same wellbore. In a simplified example, single fractures may have a coated tracer included into the slurry that deposits into the proppant or gravel in the near-wellbore or screen-annulus region.

Employing distinct tracers for each of distinct hydraulic fractures (or frac packs) may be advantageous in assessing effectiveness of acid placement into the different fractures. This is particularly true in stimulation applications involve bullheading, i.e., forcible pumping, of reactive fluid (optionally with chemical diverters or mechanical placement) into multiple exposed fractures simultaneously. The uniformity of injection of stimulation fluid (e.g., acid) into all of the exposed fractures is often inefficient. However, advantageously using the methods and coated tracers, the identity and relative concentration of tracer in the spent acid recovered to the surface can be used to identify the specific fractures that received acid stimulation.

The amount of coated tracer pumped downhole may vary depending upon factors such as the type of well, volume of fracture/annulus, wellbore dimensions, type of produced fluids, coated tracer composition, desired detection method, selection of acid treatment, and volume of being detected. Generally, the concentration of coated tracer is at least enough such that it is readily detectable but is not so high that it substantially interferes with pumping. In some embodiments, the concentration of coated tracer relative to the solids being pumped downhole is low. That is, the concentration of coated tracers may be less than about 10% of the weight of proppant, or less than about 5% of the weight of proppant, or less than about 1% of the weight of proppant.

Example Tracers

The specific tracer employed in the methods described herein is not particularly limited. Generally, it is preferred that the tracer be soluble in the reservoir fluid or injected fluid which fluid may include, for example, oil, water, brine, dissolved gases, or any mixture thereof. In addition, when detecting acids it is often preferred that the tracers be compatible with fluids that include acids such as spent or partially spent acids. In addition, it is usually preferred that the tracer will not substantially degrade, cause precipitation of any other substances present, or precipitate itself when exposed to acidic solutions or conditions, including reservoir conditions during extended ageing of coated tracer. It is usually preferred that the tracers employed are identifiable and detectable without significantly changing its chemical or physical properties. However, in some cases tracers may be employed that are indirectly detected and quantified, e.g., the tracer reacts in a known way with a produced fluid component to form an identifiable and measurable component. The tracer may be detectable by one or more analytical methods. Such methods include, for example, gas or liquid chromatography, fluorimetry, spectroscopy, distillation, ion chromatography, or any other suitable detection method.

There are many different tracer chemical identities that may be employed and the selection of a particular tracer may vary depending upon the well, the produced fluids, acid or other treatments, and/or desired results. For example, one or more benzoic acids or alkali metal or alkaline earth metal salts such as sodium salts of benzoic acids, having between zero and five functional groups may be employed. Preferred functional groups include (but are not limited to) halogens (e.g., fluorine, chlorine) or short substituted or unsubstituted alkane chains (C1-C4 alkyl groups such as methyl groups), although any functional group may be used. The tracer may be a solid or a liquid with or without one or more solvents.

Another useful family of tracers may include derivatives of naphthalene sulfonic acids or their alkali metal or alkaline earth metal salts such as sodium salts of naphthalene sulfonic acids, having between one and three sulfonate functional groups in any position. The tracer may be a solid or a liquid with or without one or more solvents.

Other useful tracers may include ionic salts such as, for example, sodium chloride, potassium iodide, magnesium sulfate, or sodium bromide, another ionic salt, or any combination of ionic salts. The tracer may be a solid or a liquid with or without one or more solvents.

Other useful tracers include biological material like DNA, RNA, viral particles, bacteria, fungi, or other biological materials. These biological materials may be either a solid, a solid suspended or dissolved in a liquid, or a liquid with or without solvents. If desired, such tracers may be encapsulated or bound in a suitable material such as a silica, a polymer, or other binder having an average diameter of from about 5 to about 500 μm.

Other useful tracers include small particles having an average diameter of from about 1 to about 500 μm. Such particles may comprise silicon, carbon, a mineral (quartzite, hematite, zeolite, or another mineral), a metalloid or nonmetal, a metal, a transition metal, a lanthanide, a metal oxide, an actinide or other atomic or molecular compositions. Each of the aforementioned small particles or any mixture or alloy thereof may serve as a unique identifier and may be embedded or dispersed within a primary material.

Useful tracers also may include solid or liquid dye or contrast agent. For example, food grade dyes such as Red Dye #40, medical contrast agents such as fluorescein, or fluorescent dyes including any dye from the Rhodamine family. Mixtures of these dyes or contrast agents also may be employed.

Other useful tracers include polymers such as, for example, polysaccharides or other biopolymers, polyacrylamides or other synthetic polymers, or mixtures of more than one polymer.

In some embodiments the tracer material may include a radioactive isotope, including but not limited to tritium, Iridium-192, Iodine-131, or any other elemental isotope or combination of isotopes.

Of course, any suitable mixture of the aforementioned tracers may also be employed.

Coatings

The tracers described above and used herein are typically used with a suitable coating. In this manner the tracer may be protected downhole for an extended period of time with minimal to no release from the coated/protected state until the coating encounters, for example, acidic conditions. The coating material is not particularly limited so long as it has a suitable thickness, suitable permeability, and suitable resistance to crush and premature degradation. The degree of such coating properties necessary, of course, may vary depending upon the specific application and other properties as described below.

The thickness of the coating could vary depending on the ability of the coated tracer composite to achieve the remaining desired properties. In some embodiments, the coated tracers may be sized similar to a proppant with which the tracer will be co-injected. As such, the coating thickness in some embodiments is such that the coated tracer has an average particle size diameter (or longest dimension if not spherical) of from about 100 μm to about 1000 μm in diameter. In some embodiments, the coating thickness is sufficient to ensure low permeability and/or high crush resistance and thus the coating thickness may be from about 1 μm to about 100 μm thick.

The permeability of the coating may be another parameter to consider. That is, the protective coating should be substantially impermeable to the surrounding fluid environment until the tracer inside is to be used to assess acid stimulation. The substantial impermeability of the coating also may advantageously include resistance to diffusion (under substantially static conditions) and resistance to leakage during flowing conditions of fluids such as hydrocarbons, water, gases, and mixtures thereof during production and/or injection prior to any acid stimulation operations.

The coating should also be designed such that it is resistant to mechanical crush or degradation during production and/or injection. The coated tracers are generally placed downhole during pressure pumping operations. In these operations, slurries of proppant are pumped downhole at relatively high rates and are optionally placed into a hydraulic fracture that will apply closure stress to a composite pack following frac/frac-pack placement. The tracer coating thickness and tracer coating material are typically designed to substantially resist mechanical damage that would prematurely release the tracer into the surrounding fluid medium. Of course, a release or damage to some small portion of coated tracer may be tolerated depending upon the application. Thus, the coating generally should be resistant to mechanical damage that causes tracer release during initial placement of the proppant downhole during hydraulic fracture or gravel pack placement, as well as during residence within an optional fracture or gravel pack.

In some embodiments the coating is insoluble at a pH above about 7, or above about 6.5 and wherein the coating is soluble at a pH below about 6, or below about 5, or below about 4.

A non-limiting list of example coatings is detailed below:

Calcium Carbonate: As detailed in WO/2023114893, one acid-degrading coating suitable for the current invention would be application of a layer of calcium carbonate to protect the outside of the tracer.

In one optional embodiment, calcium carbonate particles could be incorporated into an otherwise non-pH-sensitive coating (e.g., polymer coating); exposure to acid during stimulation operations could render the coating porous, allowing the tracer to leach through the exposed coating-pores into the acid that undergoes flowback to the surface.

Polymers: Suitable polymers could be deposited in pure form or in a form to be crosslinked before, during, or after the deposition onto the tracer. These polymers could further be rendered to form a hard coating or a more pliable coating (as each is able to meet the above performance criteria). A nonlimiting series of possible polymer coatings is outlined below:

Hydrogels: Hydrogel coatings, such as polysaccharides, could be deployed in various forms. For example, crosslinked chitosan could be used to coat suitable tracers.

Crosslinked-Polysaccharides: Crosslinked-polysaccharides may be a suitable form of pH-sensitive coating. Polymers such as guar could be employed to form strong crosslinks with borate, titanate, zirconate, and other functionalities. In this manner exposure to a lower-pH destabilizes the crosslink, weakens the coating, and releases tracer.

Crosslinked-polymer layers: Many polymers could be used to form a stable crosslink in a manner similar to crosslinked-polysaccharides. In such composites, the crosslinked-network of the coating are highly stable in neutral and higher-pH values, where the crosslink is strongest. However, on exposure to acidic stimulation fluid, the crosslink is destabilized by the fluid's low-pH being below the pKa of functionalities that participate in crosslinking. This pH-induced decrosslinking would render weaker coatings would then release the coated tracer. One example of this coating chemistry could include a metal-crosslinked polyacrylamide, where the pKa of the acrylate is roughly 4.5. Alternative examples could include a coating comprising polysaccharide which is crosslinked by borate or metallic derivatives.

Silica coatings: An additional form of coating is the application of a silica coating to protect the tracer core. Various forms of silica could be employed to coat various forms of tracer.

In optional embodiments, following initial application of a nonfunctionalized silane coating, an additional thin organosilane coating could be applied to the outside of the tracer with various organic functionalities. The organic functional groups could be used to change the wetting of the silane coatings, optionally toward repelling downhole fluids that might prematurely degrade the tracer coating.

Coated-Tracer Composite Material Properties

In addition to the properties of the individual tracer and coating components, the composite material may employ other techniques.

Porous cores impregnated with tracer: As described above, live chemical tracer (or solution-concentrates) may be coated and employed downhole. In optional embodiments, the tracer could initially be impregnated or infused into porous solid materials prior to application of the protective coating. This may be advantageous for coating efficacy of otherwise liquid tracers that are not easily coated while in a liquid form. Another potential advantage may be increased strength of the resulting core/coating composite (versus otherwise coated pure tracer). Suitable porous solids that could be impregnated or infused with tracer include zeolites and other porous solids. In alternative embodiments, diatomaceous earth could be employed as an agent in which to incorporate tracer molecules. Once a tracer is incorporated into some solid, then a suitable coating as described above may be applied.

Specific Embodiments

FIG. 1 shows a porous solid material (zeolite, polymer, mineral or another solid) impregnated with soluble tracer material. That is, as shown in FIG. 1 coated and embedded tracers are protected from solubility in the produced fluid. But when the coating is activated when subjected to acidic conditions, the spent acid will penetrate the porous solid and dissolve the embedded tracer before recovering it to the surface.

Figure 2:
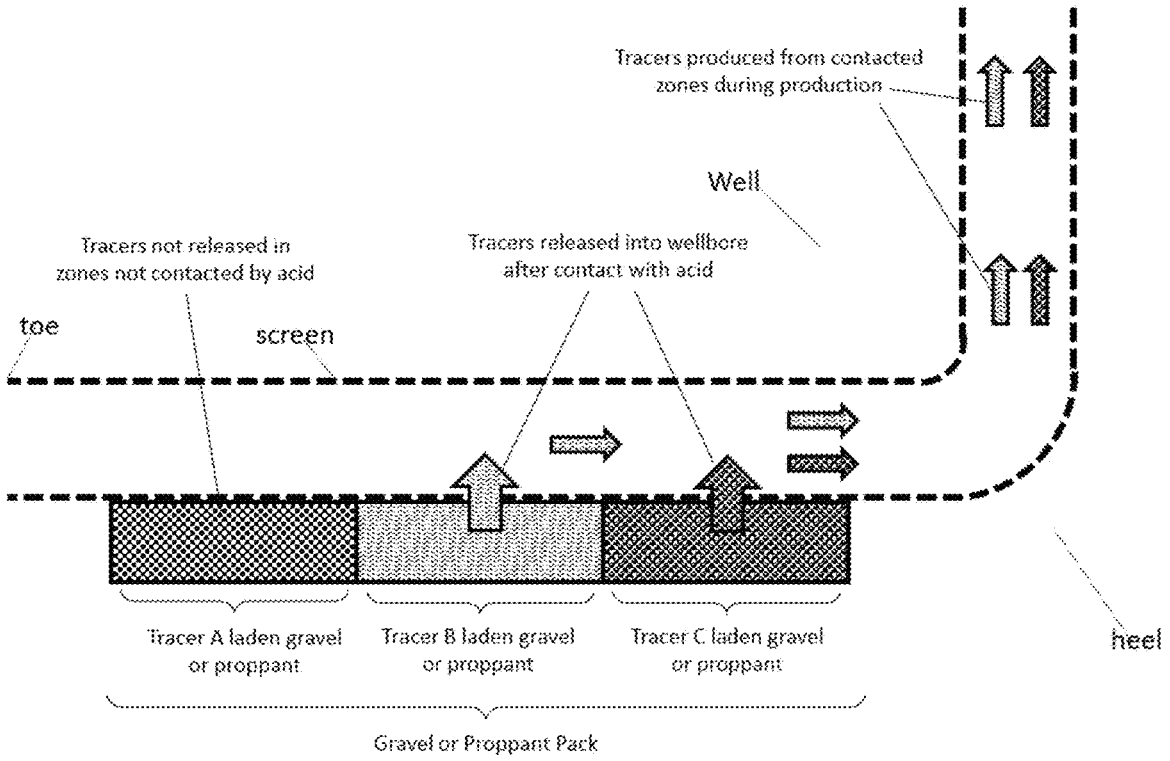
FIG. 2 shows a depiction of recovered tracer transferred to the surface.
Figure 3:
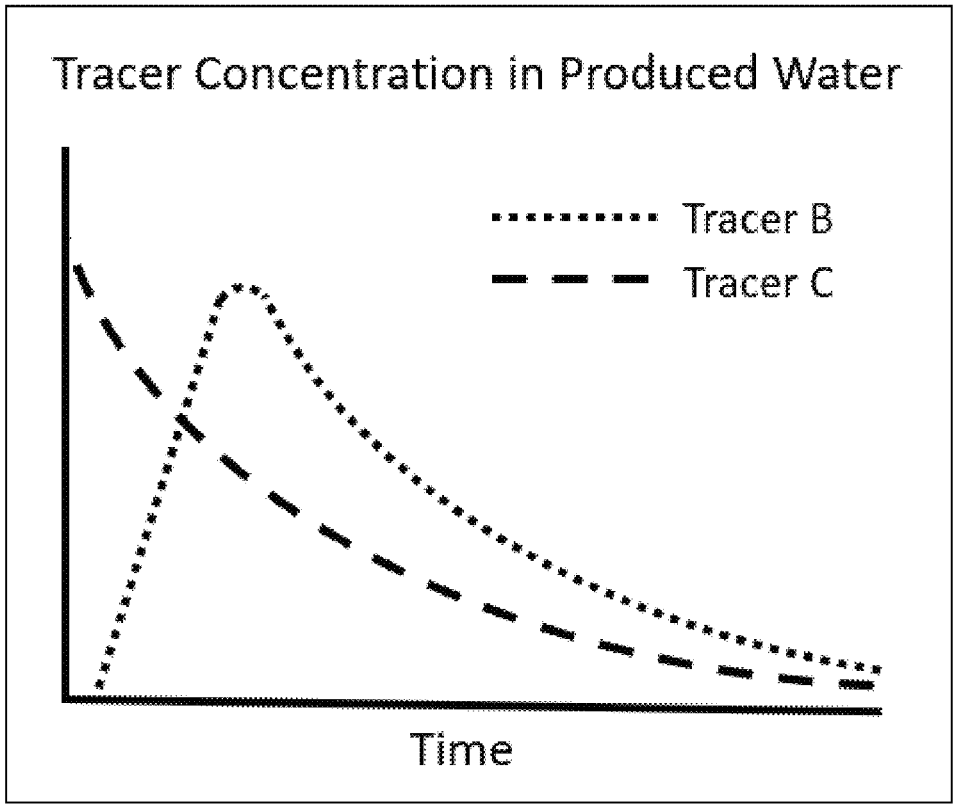
FIG. 3 shows a depiction of tracer concentration in produced water over time.

FIG. 2 shows a depiction of recovered tracers transferred to the surface. Specifically, FIG. 2 shows three zones each having a different coated tracer that has been placed at pre-determined downhole locations in the hydrocarbon well. After acid treatment Tracers B and Care released into wellbore after the coatings from Coated Tracers B and C has been dissolved or otherwise treated by acid to release the tracer in the one or more coated tracers. Tracer A has not been released as sufficient acid has not made it into the zone that is laden with Coated Tracer A. FIG. 3 shows the tracer concentration in produced water over time in FIG. 2. Tracer C which was contacted by acid first shows a decreasing concentration over time as the majority to all of Tracer C is produced. Tracer B which was contacted later shows an increase in concentration over time until it too starts to decrease as the majority to all of Tracer B present in the zone is produced.

Figure 4:
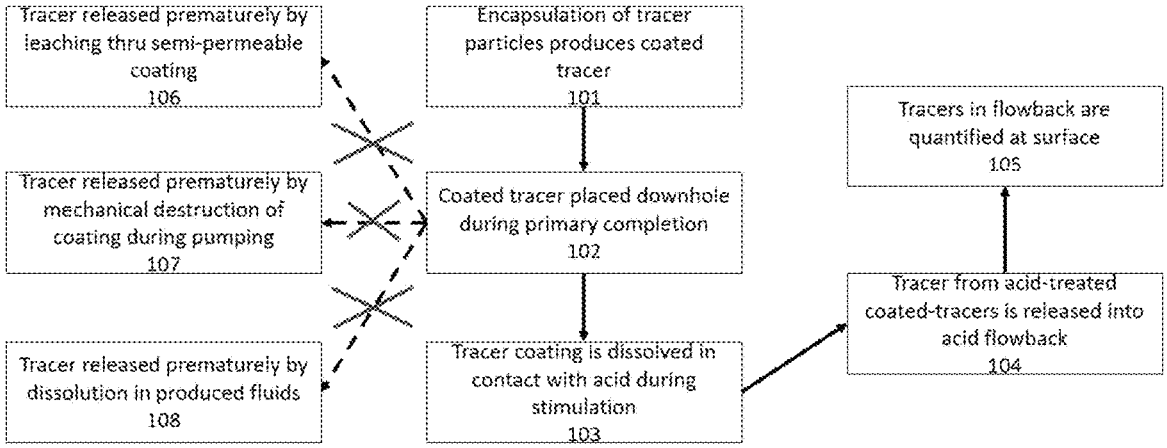
FIG. 4 shows a depiction of a representative tracer release mechanism.

FIG. 4 shows a depiction of a representative tracer release mechanism. As shown in FIG. 4, 101 involves making one or more coated tracers and then 102 shows the placing of the one or more coated tracers at pre-determined downhole locations in the hydrocarbon well. While this may be done at any time, it is often conveniently done during primary completion as shown in FIG. 2. After acid stimulating the hydrocarbon well 103 shows that a tracer coating is dissolved by contacting acid during or after acid stimulation. That releases the tracer into acid flowback in the produced fluid from the hydrocarbon well as shown in 104. The tracers are then quantified in a convenient manner in 105. Employing the teachings herein one may avoid substantial amounts of premature tracer release due to one or more of the mechanisms shown in 106, 107, and 108 of FIG. 4.

Figure 5:
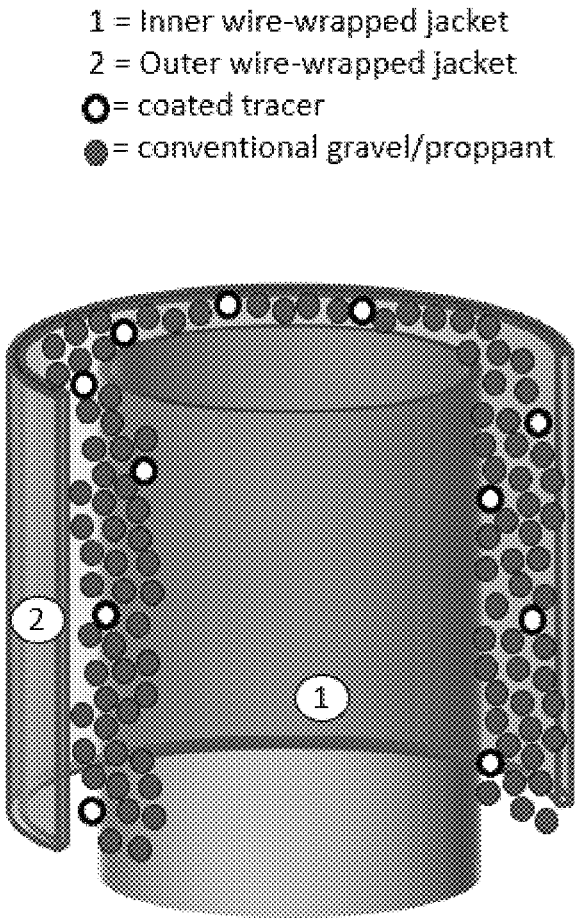
FIG. 5 shows a depiction of prepacked screen that is laden with a coated tracer.

FIG. 5 shows a depiction of prepacked screen that is laden with a coated tracer. As shown in FIG. 5 an inner wire-wrapped jacket 1 has a coated tracer mixed with a proppant such as gravel and secured with an outer wire-wrapped jacket. The prepacked screens may then be place at predetermined downhole locations in the hydrocarbon well. Of course, different tracers may be used at different locations and/or in different screen sections as desired so that acid stimulation as a function of screen length and/or effectiveness may be monitored.

Figure 6:
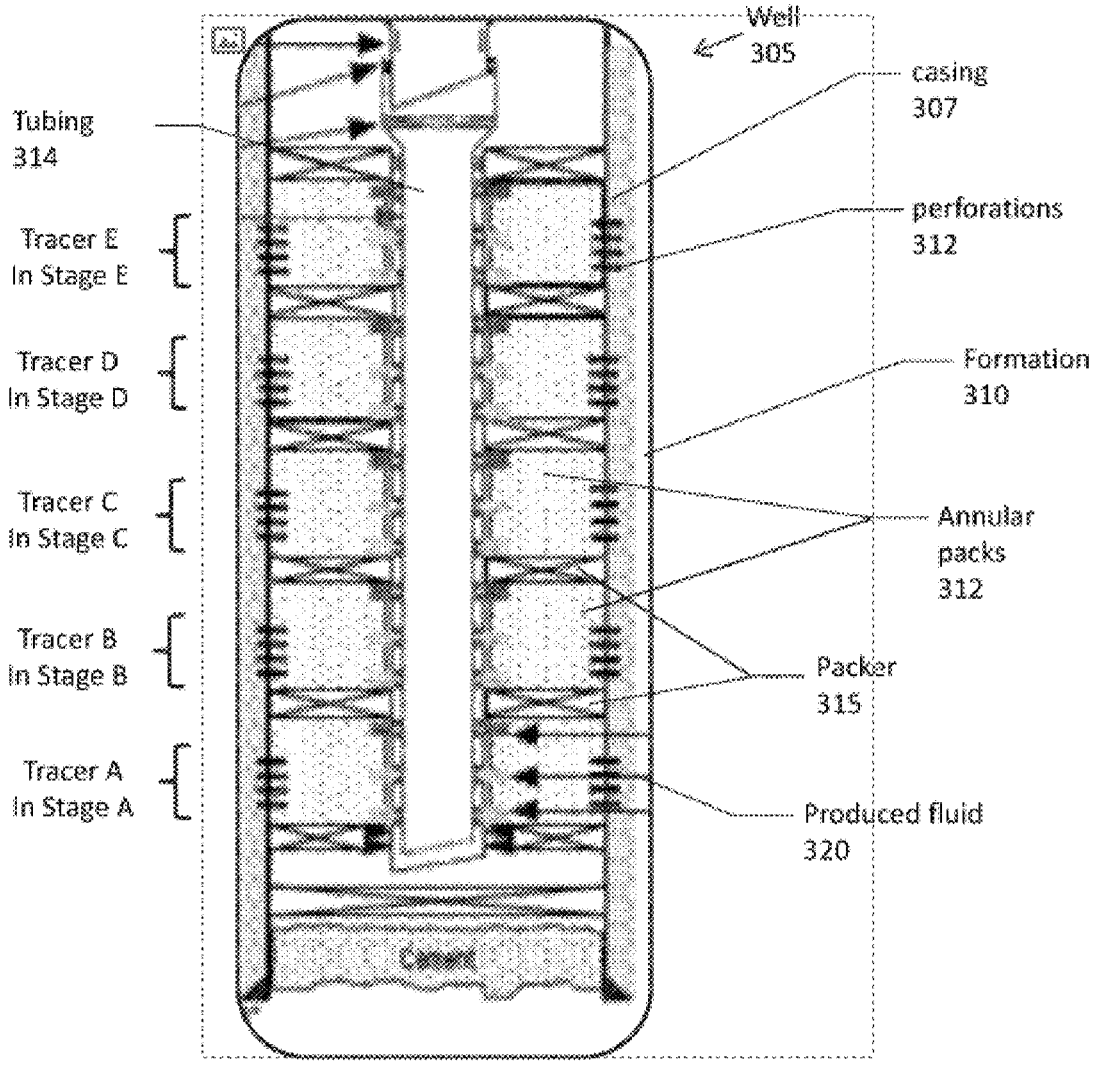
FIG. 6 shows a portion of a wellbore with multiple fracturing packs, each of which comprises distinct coated tracers.

Referring now to FIG. 6, a cross-section of a well system is illustrated. The well system can be located on land or could be a deepwater well where assessing the effectiveness of an acid stimulation operation is typically challenging. The well system comprises a hydrocarbon well 305 located in a formation 310 that comprises a hydrocarbon reservoir (not shown). The well 305 comprises a casing 307 and multiple annular packs 312 positioned between multiple packers 315. The annular packs 312 are positioned adjacent to perforations 312 in the casing 307 which are aligned with zones of the formation 310. While the example well system of FIG. 6 illustrates five fracturing stages labeled A through E with corresponding annular packs 312, it should be understood that alternate embodiments may have as few as two fracturing stages or more than five fracturing stages.

Coated tracers such as those previously described can be placed within the hydrocarbon well 305 during the initial completion of the well. Specifically, different coated tracers are injected into each fracturing stage. The coated tracers can be injected with conventional proppant in a slurry through the entire treatment of the well so that the proppant and coated tracers are positioned in the annular packs as well as the adjacent hydraulic fractures in the formation. Alternatively, the coated tracers can be injected in the slurry only in the later stages of the treatment so that the coated tracers are positioned closest to the screen or wellbore.

As illustrated in FIG. 6, coated tracers comprising tracer A would be pumped into the well and into annular pack A of fracturing stage A, coated tracers comprising tracer B would be pumped into the well and into annular pack B of fracturing stage B, and so forth up to the coated tracers comprising tracer E pumped into the well and into annular pack E of fracturing stage E. Each of the tracers, A, B, C, D, and E, can be distinct so that they provide an indication of acid stimulation for each respective fracturing stage when they are produced to the surface at a later time. The coated tracers can remain in the well 305 within each annular pack, and optionally within the hydraulic fracture in the formation surrounding each annular pack, in an inert condition until an acid stimulation operation is performed at a later time in the productive life of the well.

At a later point in time, an acid stimulation operation can be performed on hydrocarbon well 305. In connection with the acid stimulation operation, an acid solution is injected into the well to stimulate fractures or openings in the formation 310. The acid solution dissolves the coating on the coated tracers thereby releasing tracers A, B, C, D, and E. A retrieved fluid, either acid flowback fluids or produced water or oil from the formation (individually or collectively referred to as "produced fluid"), brings the tracers to the surface. At the surface, the quantities of each of tracers A, B, C, D, and E can be measured to assess the extent to which the acid penetrated each zone of the well. The information gathered from analyzing the quantities of the tracers in the retrieved fluids can be used in further well operations. For example, if the analysis shows a smaller amount of tracers A and B than tracers D and E, this indicates the acid solution had greater penetration into frac-packs at stages D and E relative to frac-packs at stages A and B. The analysis can be used for further remedial operations focusing on frac-packs at stages A and B.

Figure 7:
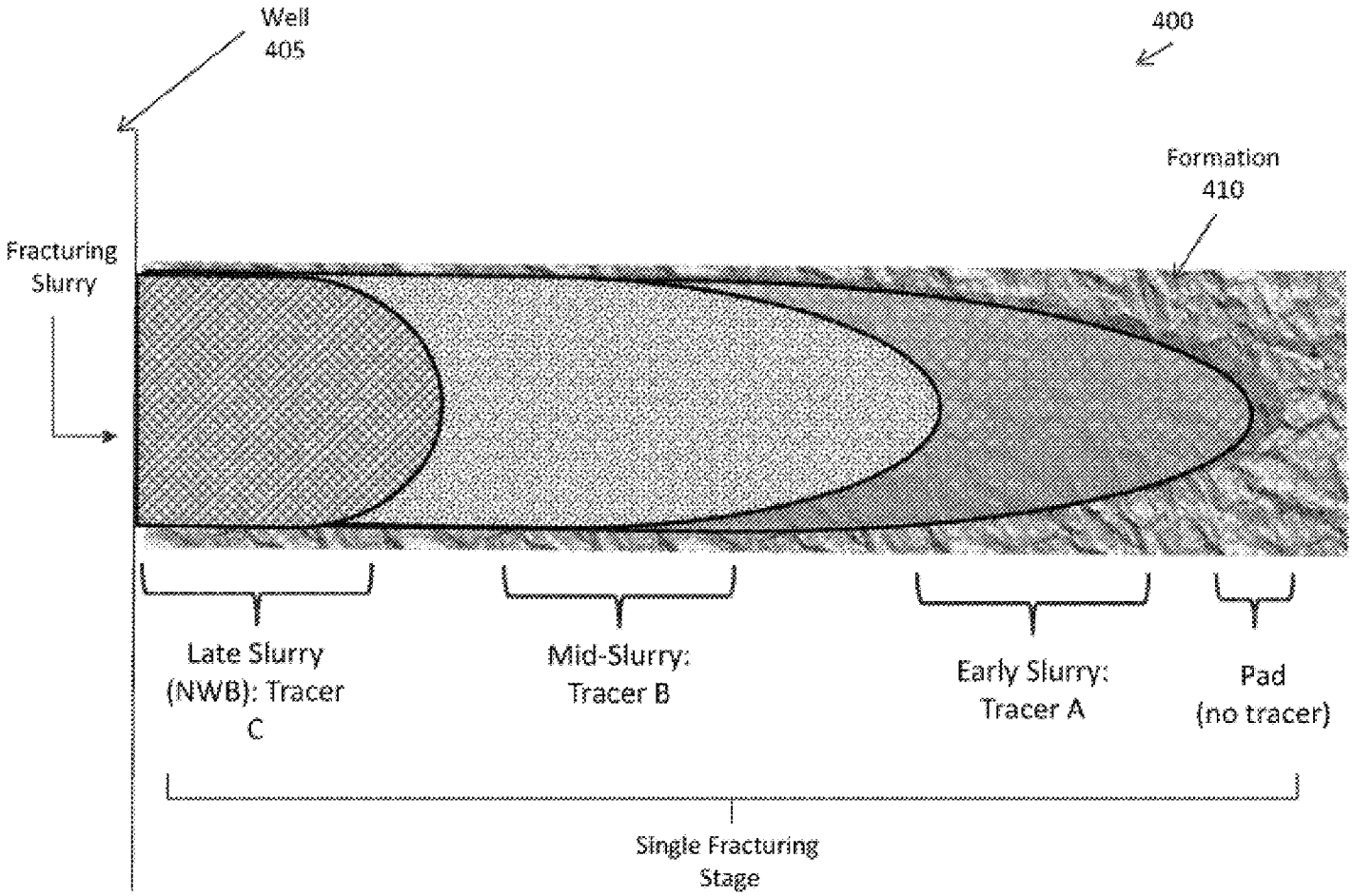
FIG. 7 shows a portion of a wellbore and a fractured zone of a formation in which at least two types of coated tracers are deployed.

Referring now to FIG. 7, a cross-section of a well system 400 is illustrated. The well system 400 comprises a hydrocarbon well 405 located in a formation 410. To simplify the illustration, only a portion of the formation 410 is shown in FIG. 7. In the well system 400, a fracturing operation is illustrated in which the fracturing operation has a sequence of different pad and slurry phases that are pumped as part of a single fracturing stage into a formation zone. An early phase of the fracturing slurry is pumped into the formation zone and comprises coated tracers containing tracer A. The early phase of the fracturing slurry penetrates deeper into the formation zone than later phases of the fracturing slurry. Following the early phase, a mid-phase of the fracturing slurry is pumped into the formation zone, the mid-phase comprising coated tracers containing tracer B. After the mid-phase, a late phase of the fracturing slurry is pumped into the formation zone, the late phase comprising coated tracers containing tracer C. Because the coated tracers containing tracer C were the last pumped into the formation zone, they are deposited nearest the wellbore of hydrocarbon well 405.

Tracer A, tracer B, and tracer C can each comprise a different tracer material. When acid solution from an acid stimulation operation is applied to the formation zone, fluid is retrieved from well 405 in the form of flowback acid or production fluids. The retrieved fluid can contain concentrations of tracer A, B, and C. The concentration level of tracers A, B, and C present in the retrieved fluid will indicate the extent to which the acid solution penetrated the formation zone thereby providing an indication of the effectiveness of the acid stimulation operation. It should be understood that in alternate embodiments of the example well system 400 fewer or greater slurry phases can be used in the same fracture stage wherein each phase comprises a unique tracer.

Figure 8:
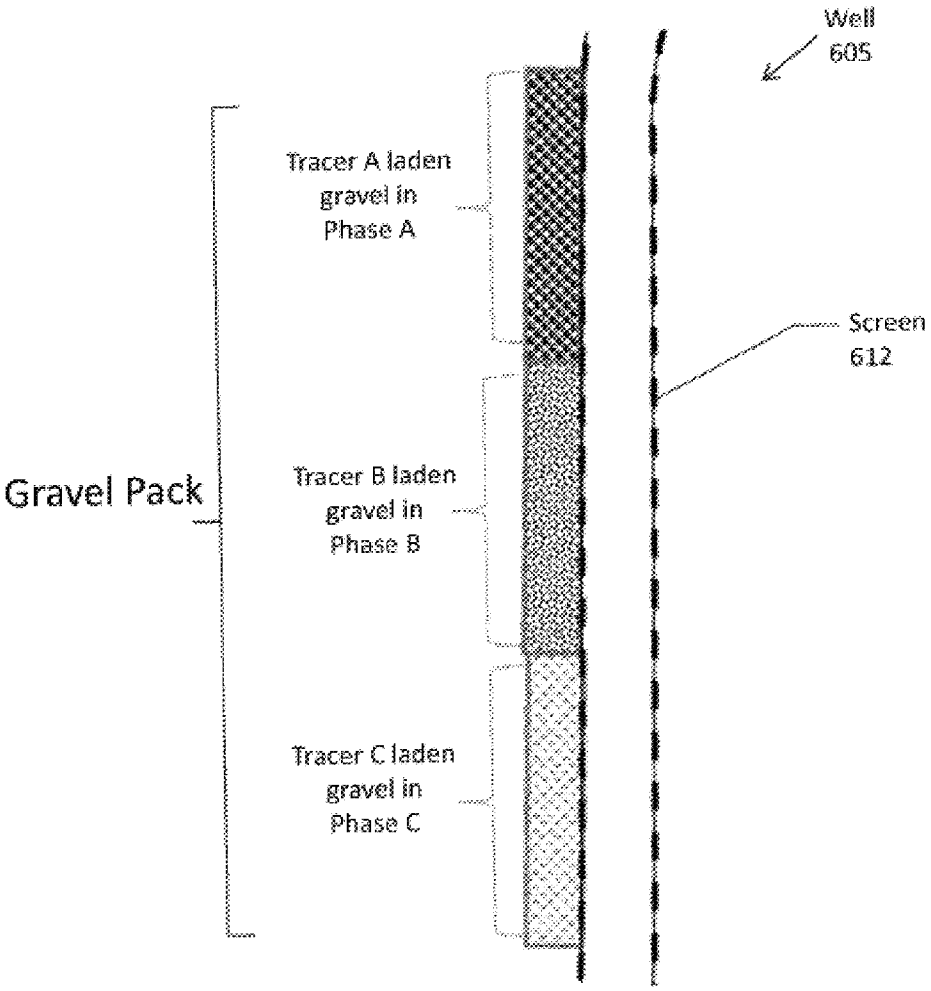
FIG. 8 shows a vertically oriented well bore in which a series of distinct coated tracers are deployed in a sequence of phases of a gravel pack along an interval length of the wellbore.

Referring now to FIG. 8, a variation on the well system of FIG. 2 is illustrated. FIG. 9 shows a cross-section of a well system comprising an open hole well 605. In contrast to well system of FIG. 2, well system of FIG. 9 includes a vertical well portion in which a gravel pack has been placed. As illustrated in FIG. 9, the gravel pack is positioned around the outer side of a screen 612. Aside from the vertical orientation, the gravel pack of the well system in FIG. 9 is similar to the gravel pack of well system in FIG. 2. That is, the gravel pack of the well system in FIG. 9 comprises phase A containing gravel laden with coated tracers A, phase B containing gravel laden with coated tracers B, and phase C containing gravel laden with coated tracers C. Similar to the description of FIG. 2, when an acid stimulation operation is performed on well system 600, the concentration level of tracers A, B, and C in the retrieved fluid can indicate the extent of acid penetration at the different phases of the gravel pack.

In the preceding specification, various embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

We claim:

1. A method of tracing acid stimulation treatment in a hydrocarbon well using one or more coated tracers, wherein the method comprises:

placing the one or more coated tracers at pre-determined downhole locations in the hydrocarbon well;

acid stimulating the hydrocarbon well; and measuring an amount of each tracer in a produced fluid from the hydrocarbon well;

wherein the one or more coated tracers each comprise a tracer and a coating.

2. The method of claim 1 wherein the placing of the one or more coated tracers at pre-determined downhole locations in the hydrocarbon well comprises co-injecting the one or more coated tracers with a proppant.

3. The method of claim 2 wherein the proppant comprises gravel as part of a gravel pack.

4. The method of claim 1 wherein coated tracers are incorporated into pre-packed screen completion installed downhole.

5. The method of claim 1 wherein the one or more coated tracers are deployed in a sequence of phases of a gravel pack along an interval length of the wellbore.

6. The method of claim 1 wherein the hydrocarbon well is an offshore well.

7. The method of claim 1 wherein said acid stimulating the hydrocarbon well comprises remedial stimulation.

8. The method of claim 1 wherein the hydrocarbon well is an angled or horizontal well.

9. The method of claim 1 wherein the tracer is soluble in the produced fluid, does not substantially react with the produced fluid, and is substantially stable when subjected to acidic conditions.

10. The method of claim 8 wherein the tracer comprises a substituted or unsubstituted benzoic acid or a salt thereof, substituted or unsubstituted naphthalene sulfonic acid or a salt thereof, an ionic salt, a biological material, particles of diameter from about 1 to about 500 μm, a dye or contrast agent, a polymer, a radioactive isotope, or any mixture thereof.

11. The method of claim 9 wherein the substituted or unsubstituted benzoic acid or a salt thereof comprises a benzoic acid or salt thereof comprising one to five functional groups wherein the functional groups comprise halogen or a C1-C4 alkyl group.

12. The method of claim 9 wherein the salt comprises an alkali metal or alkaline earth metal salt.

13. The method of claim 9 wherein the substituted or unsubstituted naphthalene sulfonic acid or a salt thereof comprises from one to three sulfonate functional groups.

14. The method of claim 9 wherein the ionic salts are selected from sodium chloride, potassium iodide, magnesium sulfate, sodium bromide, or any combination thereof.

15. The method of claim 9 wherein the biological material comprises DNA, RNA, viral particles, bacteria, fungi, or any combination thereof.

16. The method of claim 9 wherein the tracer is encapsulated or bound in a material selected from a silica, a polymer, or a binder having an average diameter of from about 5 to about 500 μm.

17. The method of claim 9 wherein the particles of diameter from about 1 to about 500 μm are selected from silicon, carbon, a mineral, a metalloid or nonmetal, a metal, a transition metal, a lanthanide, an actinide, a metal alloy or any combination thereof.

18. The method of claim 9 wherein the dye or contrast agent is a food grade dye, a medical contrast agent, or any mixture thereof.

19. The method of claim 9 wherein the polymer is a polysaccharide, a polyacrylamide derivative, or any mixture thereof.

20. The method of claim 1 wherein the coating is insoluble at a pH above about 7 and wherein the coating is soluble at a pH below about 6.

21. The method of claim 1 wherein the coating is selected from calcium carbonate; a non-pH-reactive coating impregnated with calcium carbonate to render the coating porous; a polymer; silica; and manganese oxide.

22. The method of claim 19 wherein the polymer is crosslinked.

23. The method of claim 19 wherein the polymer is chitosan, gelatin, polyacrylamide, polysaccharide, polyvinyl acetyl diethylaminoacetate and/or their derivatives, copolymers, or mixtures.

24. The method of claim 19 wherein the polymer is a crosslinked chitosan; a crosslinked-polysaccharide; guar crosslinked with a borate, a titanate, or zirconate.

25. The method of claim 1 wherein the coated tracer comprises a porous solid material surrounded by the coating wherein the tracer is incorporated into the porous solid material prior to coating of the composite tracer-impregnated porous material.

26. The method of claim 25 wherein the porous solid material comprises a zeolite.

* * * * *